US006435447B1

(12) United States Patent
Coats et al.

(10) Patent No.: US 6,435,447 B1
(45) Date of Patent: Aug. 20, 2002

(54) COIL TUBING WINDING TOOL

(75) Inventors: E. Alan Coats, The Woodlands; Thomas P. Wilson, Houston, both of TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/512,536

(22) Filed: Feb. 24, 2000

(51) Int. Cl.[7] ..... B65H 54/28; B65H 57/25
(52) U.S. Cl. ..... 242/483; 242/157.1; 242/483.3
(58) Field of Search ..... 242/483, 483.3, 242/483.5, 484.1, 484, 484.4, 157.1

(56) References Cited

U.S. PATENT DOCUMENTS

| | | | | |
|---|---|---|---|---|
| 1,307,526 A | | 6/1919 | Tuttle | 242/613 |
| 1,973,446 A | * | 9/1934 | Rosenquist | 242/483 |
| 2,058,150 A | | 7/1936 | Hayward et al. | 242/613.4 |
| 2,872,130 A | * | 2/1959 | Nardone | 242/157.1 X |
| 3,559,905 A | | 2/1971 | Palynchuk | 242/390.5 |
| 3,841,407 A | | 10/1974 | Bozeman | 166/384 |
| 4,057,202 A | * | 11/1977 | Carr, Jr. | 242/157.1 X |
| 4,063,691 A | | 12/1977 | Bacvarov | 242/613.3 |
| 4,148,445 A | | 4/1979 | Reynolds et al. | 242/388.7 |
| 4,202,512 A | * | 5/1980 | Nicholson, Jr. | 242/157.1 |
| 4,213,724 A | | 7/1980 | Holderness | 414/133 |
| 4,454,999 A | | 6/1984 | Woodruff | 242/388.7 |
| 4,649,954 A | | 3/1987 | Dunwoody | 137/355.17 |
| 4,795,108 A | * | 1/1989 | Appling | 242/157.1 |
| 4,895,316 A | | 1/1990 | Salloum | 242/608.4 |
| 5,002,238 A | * | 3/1991 | Inhofer et al. | 242/157.1 |
| 5,242,129 A | | 9/1993 | Bailey et al. | 242/608.2 |
| 5,285,204 A | | 2/1994 | Sas-Jaworsky | 340/854.9 |
| 5,289,845 A | | 3/1994 | Sipos et al. | 137/355.27 |
| 5,469,916 A | | 11/1995 | Sas-Jaworsky et al. | 166/64 |
| 5,564,637 A | * | 10/1996 | Berthold et al. | 242/157.1 X |
| 5,605,305 A | | 2/1997 | Picton | 242/608 |
| 5,735,482 A | | 4/1998 | Kuzik | 242/537 |
| 5,738,173 A | | 4/1998 | Burge et al. | 166/385 |
| 5,823,267 A | | 10/1998 | Burge et al. | 166/385 |
| 5,839,514 A | | 11/1998 | Gipson | 166/384 |
| 5,865,392 A | | 2/1999 | Blount et al. | 342/597 |
| 5,908,049 A | | 6/1999 | Williams et al. | 138/125 |
| 5,913,337 A | | 6/1999 | Williams et al. | 138/125 |
| 5,988,702 A | | 11/1999 | Sas-Jaworsky | 285/249 |
| 6,065,540 A | | 5/2000 | Thomeer et al. | 166/297 |
| 6,264,128 B1 | * | 7/2001 | Shampine et al. | 242/157.1 X |
| 6,290,166 B1 | * | 9/2001 | Aramaki et al. | 242/484.4 |

FOREIGN PATENT DOCUMENTS

| | | | | |
|---|---|---|---|---|
| EP | 0911483 A2 | | 4/1999 | E21B/17/20 |
| JP | 55-145968 | * | 11/1980 | 242/157.1 X |

OTHER PUBLICATIONS

Alexander Sas–Jaworsky, et al, "Development of Composite Coiled Tubing for Oilfield Services", SPE 26536, 1–15, (1993).

* cited by examiner

*Primary Examiner*—Michael R. Mansen
*Assistant Examiner*—Minh-Chau Pham
(74) *Attorney, Agent, or Firm*—Conley, Rose & Tayon, P.C.

(57) ABSTRACT

A winding tool operating in conjunction with a level wind spools coiled tubing in a helical pattern onto a reel. In one embodiment, the winding tool includes a plurality of rollers that are urged against the winds of coiled tubing with a biasing member. A driver provides controlled oscillatory translational movement for the rollers.

23 Claims, 7 Drawing Sheets

COIL TUBING WINDING TOOL

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to devices used to spool composite coiled tubing. More particularly, the present invention relates to devices that engage composite coiled tubing during the spooling process. Still more particularly, the present invention relates to devices that compressively engage a winding of composite coiled tubing that is being spooled onto a reel. Still more particularly, the present invention relates to devices that oscillate axially to compressively engage consecutive windings of composite coiled tubing that are being spooled onto a reel. Another feature of the present invention relates to methods of spooling composite coiled tubing onto a reel in an even helical layer.

2. Description of the Related Art

Coiled tubing, as currently deployed in the oilfield industry, generally includes small diameter cylindrical tubing made of metal or composites that have a relatively thin cross sectional thickness. Coiled tubing is typically much more flexible and much lighter than conventional drill string. These characteristics of coiled tubing have led to its use in various well operations. Coiled tubing is introduced into the oil or gas well bore through wellhead control equipment to perform various tasks during the exploration, drilling, production, and workover of a well. For example, coiled tubing is routinely utilized to inject gas or other fluids into the well bore, inflate or activate bridges and packers, transport well logging tools downhole, perform remedial cementing and clean-out operations in the well bore, and to deliver drilling tools downhole. The flexible, lightweight nature of coiled tubing makes it particularly useful in deviated well bores.

Conventional coiled tubing handling systems typically include a reel assembly, a tubing injector head, and steel coiled tubing. The reel assembly stores and dispenses tubing and typically includes a cradle for supporting the reel, a rotating reel for storing and retaining the steel coiled tubing, a drive motor to rotate the reel, and a rotary coupling attached to the reel for the injection of gas or liquids into the steel coiled tubing. The tubing injector head pays out and takes up the steel coiled tubing from the borehole.

While prior art coiled tubing handling systems are satisfactory for coiled tubing made of metals such as steel, these systems do not take advantage of beneficial properties inherent in coiled tubing made of composites. One such property is that composite coiled tubing is significantly lighter than steel coiled tubing of similar dimensions. Another useful property is that composites are highly resistant to fatigue failure, which is often a concern with steel coiled tubing. These unique characteristics of composites markedly increase the operational reach of drill string made-up with composite coiled tubing. Thus, composite coiled tubing may allow well completions and workovers to depths previously not easily achieved by other methods. However, these dramatic improvements in drilling operations require handling systems that efficiently and cost-effectively deploy extended lengths of composite coiled tubing.

At the same time, prior art steel coiled tubing handling systems do not adequately address the unique problems inherent with composite coiled tubing. For example, the handling of composite coiled tubing is often complicated by a problem known as "snaking." Snaking occurs when composite coiled tubing is reeled back onto the spool following a trip downhole. Snaking is defined as an undesired non-uniform coiling of the tubing upon the spool assembly so that the organized fashion in which the tubing is preferred to be stored is disrupted and use of the reel storage space is no longer maximized. The tendency of composite coiled tubing to "snake" appears to be caused by non-uniformities in the composite material, which in turn may be attributable to variances in the manufacturing process. Snaking on the reel can lead to the tubing becoming tangled during successive deployment operations, thereby increasing process time and cost of service.

Prior art coil tubing handling systems often include a level wind that travels back and forth longitudinally along a reel during spooling. While a level wind may initially align the composite coiled tubing in a smooth wrap, the tension in the spooled composite tubing may be insufficient to maintain the smooth wrap. In such situations, the composite coiled tubing may jump, leading all subsequent wraps to fall into a highly undesirable sinusoidal wrapping pattern.

Prior art steel coiled tubing systems also use stationary mechanical restraints in certain applications. An exemplary mechanical restraint includes a stationary wide compliant roller mounted on a hydraulic piston. The compliant roller presses against the outer layer of steel coiled tubing to prevent the steel coiled tubing from spiraling or unwinding off of the reel. This system is somewhat effective for steel tubing, because steel coiled tubing tends to unwind from the reel to release the considerable potential energy gained when the steel coiled tubing is bent to conform to the contour of the reel.

In contrast, composite coiled tubing does not exhibit as great a tendency to spiral or unwind in a similar fashion because composite coiled tubing is relatively more flexible than steel coiled tubing and thus requires much less energy to bend. Instead, coil tubing tends to kink, or shorten in length when placed on the reel without back-tension. Accordingly, devices that tend to resist only spiraling or unwinding do not adequately address the susceptibility of composite coiled tubing to unpredictable non-uniform movement.

A manual procedure to prevent snaking of composite tubing can be tedious and time-consuming. The take up process must be performed slowly and with much care and supervision. Because a faster take up process saves time and money, there is a need for a handling system that minimizes the effects of snaking. While oil and gas recovery operations could greatly benefit from coil handling systems capable of handling long lengths of coiled tubing made of composite and other similar material, the prior art does not disclose such handling systems.

SUMMARY OF THE INVENTION

The present invention features a winding tool that maintains the ordered pattern of windings of composite coiled tubing as the tubing is spooled onto a reel. The winding tool includes a guide, a biasing member, a base, and a driver. Soon after a winding is spooled onto the reel, the biasing member urges the guide against the previous winding so as to prevent undesired movement of the winding. The biasing member is mounted on a base that is propelled by the driver in a oscillatory fashion along the axis of the reel. Optionally, the base may be adapted to ride on a track that provides stability during movement.

In another embodiment, the winding tool features a frame, a guide and a biasing member. The frame includes a lead screw on which the guide is threadedly mounted. The frame also includes a belt arrangement for transferring rotational movement to the lead screw. Rotation of the lead screw propels the guide in oscillatory translational movement. The guide has a plurality of rollers having arcuate surfaces adapted to receive the windings of composite coiled tubing. The biasing member connects with the frame and thereby ultimately urges the guide against the windings.

Thus, the present invention comprises a combination of features and advantages that enable it to overcome various shortcomings of prior art coiled tubing handling devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

Figure 1:
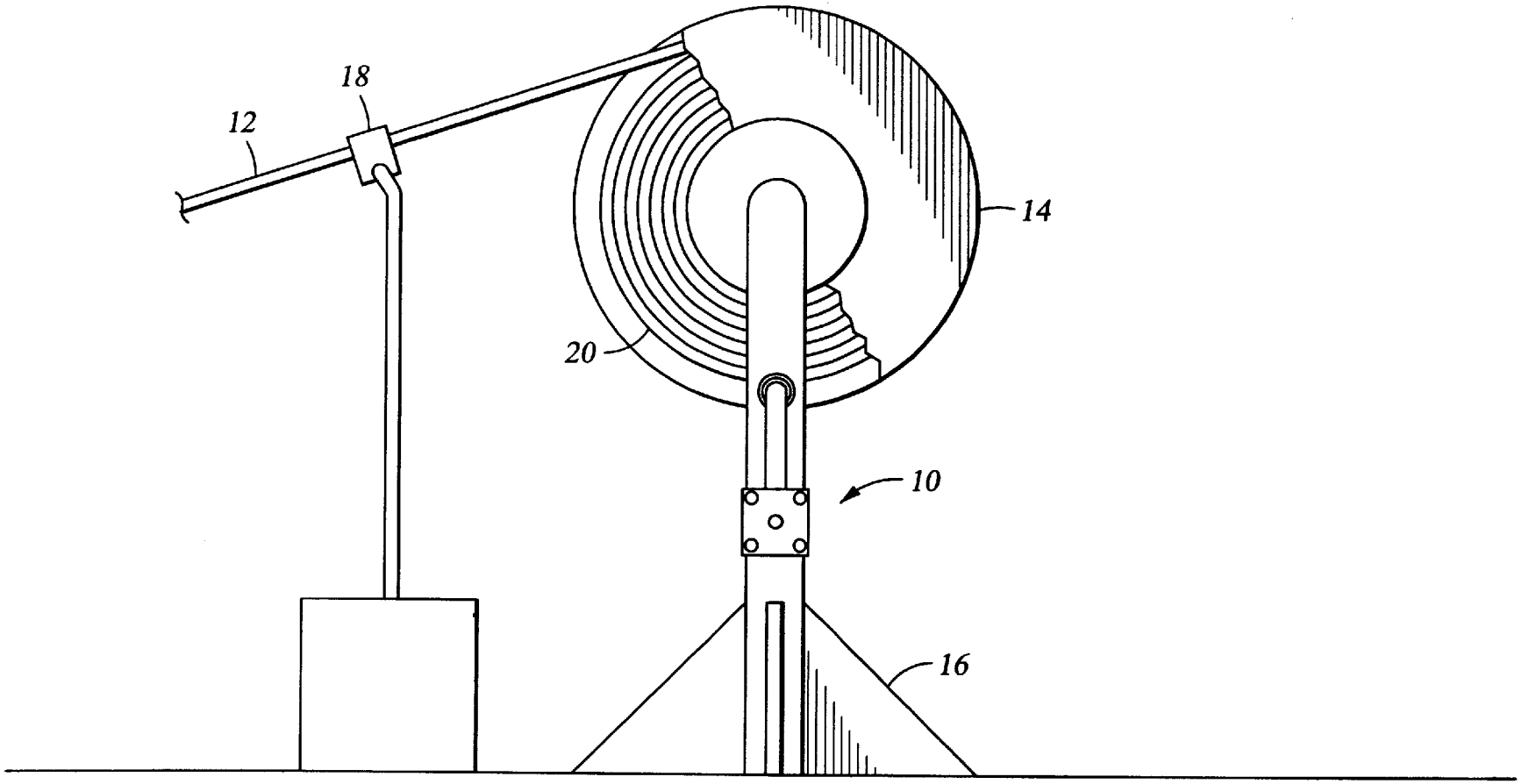
FIG. 1 illustrates a coiled tubing reel arrangement featuring an embodiment of the present invention.

Referring now to FIG. 1, a preferred winding tool 10 is shown as a part of a system including coiled tubing 12, a reel 14, a cradle 16, and a level-wind 18. Coiled tubing 12, as used hereinafter, refers to flexible tubular members made of composite material or any other material that exhibits a tendency to jump or snake when spooled onto reel 14. Composite tubulars are discussed in U.S. application Ser. No. 09/081,981, entitled "Well System," filed on May 20, 1998, which is hereby incorporated by reference for all purposes.

Cradle 16 is a conventional support structure for reel 14 and may include auxiliary connections and equipment such as are known in the art (not shown). Reel 14 is rotatably disposed within cradle 16 and may be capable of storing thousands of feet of coiled tubing 12 and thus may be several feet in diameter. A design for a transportable reel 14 is discussed in U.S. application Ser. No. 09/502,317, filed Feb. 2, 2000 and entitled "Coiled Tubing Handling Systems and Methods" which is hereby incorporated by reference for all purposes. Cradle 16 includes an axle (not shown) that engages reel 14. Axle and reel 14 are preferably rotated by a motive force such as an electric motor coupled to a belt drive or a hydraulic drive.

Typically, the operation of reel 14 and an associated tubing injector (not shown) are coordinated in order to pay out and retrieve coiled tubing 12. When coil tubing 12 is being spooled onto reel 14, it is preferred that it produce even layers of helical windings. For purposes of this discussion, "spool" or "spooling" refers to the process of rotating a reel 14 to draw in coiled tubing 12. A "winding" or "windings" refers to a length of coiled tubing 12 that has been disposed on reel 14 by rotation of reel 14. Windings are generally designated with numeral 20. Each winding 20 is initially positioned on reel 14 in an orderly helical fashion by level-wind 18. As is well known in the art, level-wind 18 includes a drive mechanism that provides controlled translational movement along a line parallel to the axis of reel 14. The mechanism includes a self-actuating switch that reverses the direction of travel once the axial ends of reel 14 are reached. Thus, during operation, level-wind 18 moves in an oscillatory translational fashion.

The designs of cradles, reels and level-winds are generally known in the art and will be apparent to one of ordinary skill in the art. Accordingly, the particulars of their designs will not be discussed in detail.

Figure 2:
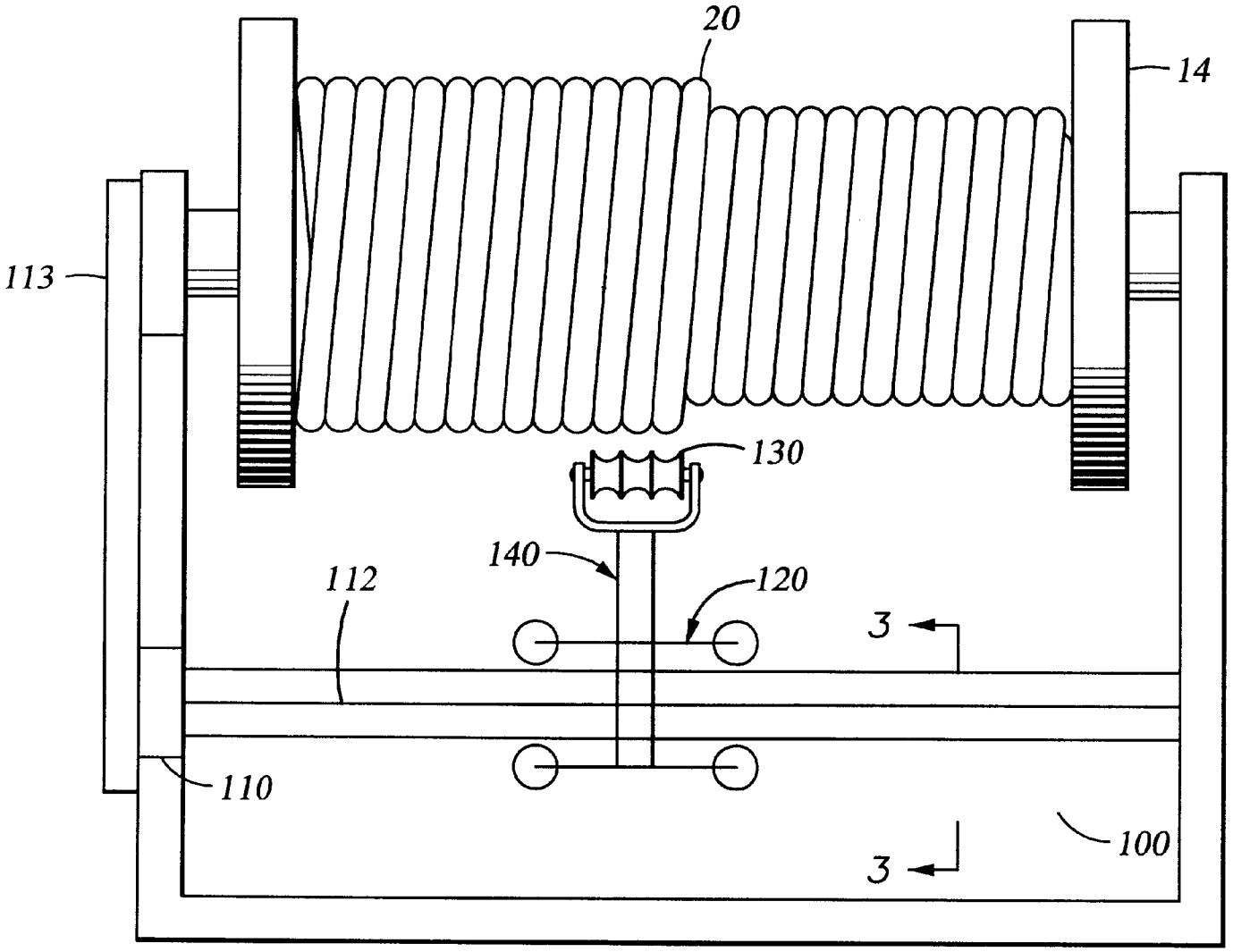
FIG. 2 is a side view of an embodiment of the present invention.

Referring now to FIG. 2, winding tool 10 engages and compresses each winding 20 formed by level-wind 18 (FIG. 1) and the rotation of reel 14. A preferred winding tool 10 includes a track 100, a driver 110, a base 120, a tubing guide 130 and a biasing member 140. As coiled tubing is spooled onto reel 14 in an orderly fashion by level-wind 18 (FIG. 1), guide 130 bears on the newly-laid winding 20 and prevents it from snaking.

Figure 3:
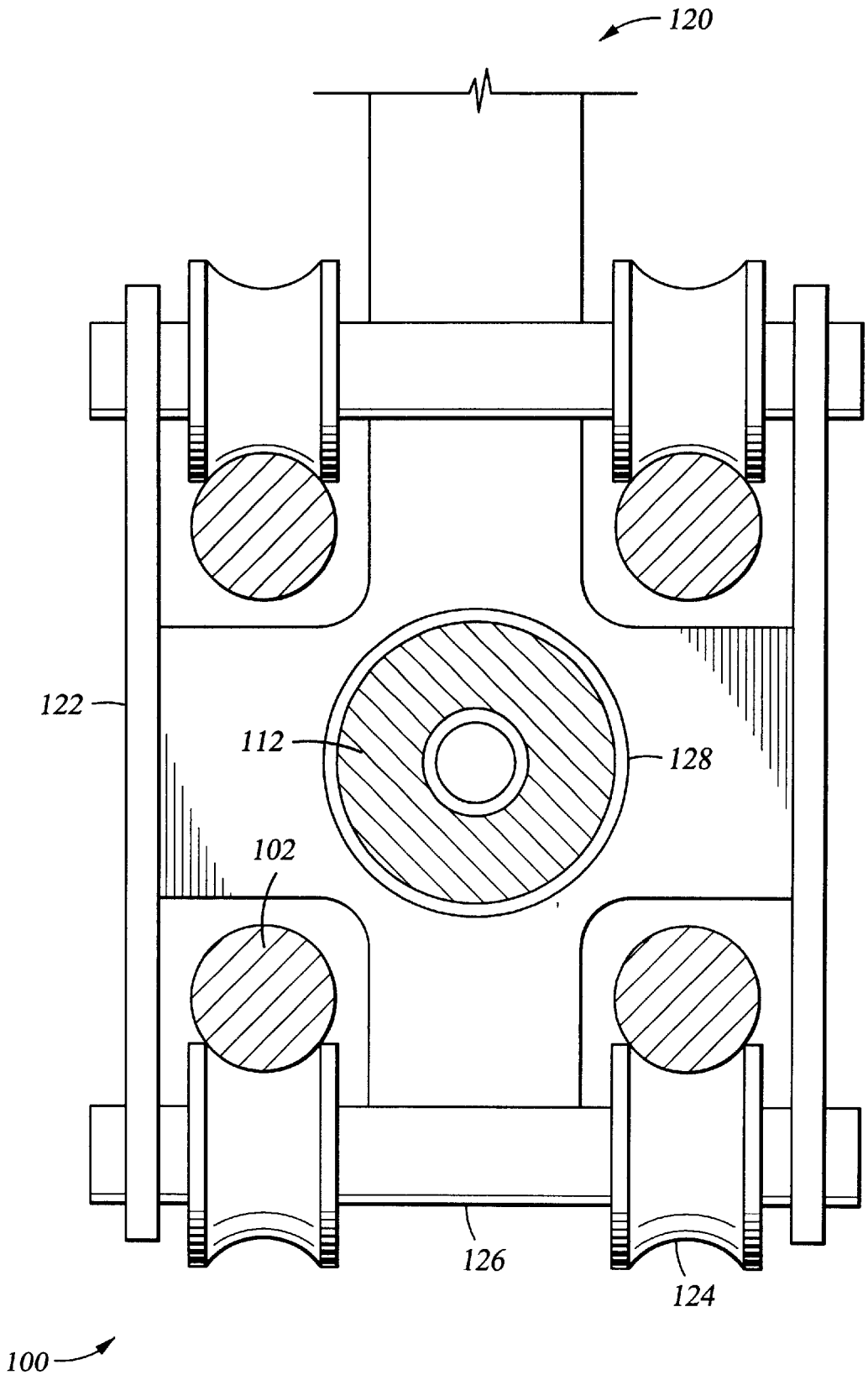
FIG. 3 is a partial sectional view of the FIG. 2 embodiment of the present invention.

Referring now to FIG. 3, track 100 stabilizes the movement of base 120. According to one embodiment, track 100 preferably includes four rails 102 arranged in a stacked paired fashion and surrounding a lead screw 112. Rails 102 may comprise solid steel dowels or rods. Alternatively, rails 102 may comprise hollow tubular members. It will be understood that a particular application may demand more than four rails 102 or may require less than four rails 102. Further, although a circular cross-section has been shown for rails 102, it will be understood that generally squared configurations or other cross-sectional configurations may be employed just as easily. It will also be understood that during operation, base 120 will impose bending moments and shearing forces on rails 102. Thus, the materials selection and design should account for the particular stresses and tensions and other forces that may be encountered during operation. Indeed, such analyses may indicate that rails 102 may be eliminated altogether if it is found that driver 110 (FIG. 2) provides sufficient support for base 120.

Referring still to FIG. 3, base 120 rides on driver 110 and provides structural support for guide 130 during operation. Base 120 preferably includes a chassis 122, eight wheels 124 and four axles 126. Chassis 122 includes a threaded bore 128 adapted to receive lead screw 112. Thus, rotation of lead screw 112 is converted into controlled translational movement of base 120. Axles 126 are disposed in an outboard fashion on chassis 122. Each axle 134 supports two wheels 124 adapted to ride on track rails 102 during translational movement. It should be understood that more or fewer wheels 124 may be used, or that a roller-shaped wheel or any other suitable translatable support device may be substituted for wheels 124. Alternatively, chassis 122 may utilize sleeves in lieu of some or all wheels 124. Indeed, nearly any arrangement that provides stability for base 120 during translational movement may be satisfactorily employed.

Referring again to FIG. 2, driver 110 rotates lead screw 112 about its axis to propel base 120 at a predetermined rate of travel. Lead screw 112 is disposed parallel to the axis of reel 14 and provides travel along a distance substantially equal to the full length of reel 14. The rate of travel may be defined as an axial distance per one rotation of reel 14. Typically, the rate of travel will correspond to the gage diameter of coiled tubing 12 spooled on reel 14. Thus, for 2⅞ inch gauge composite tubing, it is expected that the rate of travel should be 2⅞ inch per rotation of reel 14. By taking into account the threads per inch of driver 110, the rotational speed of reel 14, the diameters of the several linked components, the necessary rate of travel can be established. It will be seen that such a rate of travel allows base 120 to smoothly follow each successive winding 20 formed during the spooling process. It will be understood that a lead screw having a threaded surface is only one of numerous arrangements suitable for providing an oscillatory driving force for base 120. Devices such as indexed ratcheting mechanisms or conveyor-type arrangements using belts or cables may also prove satisfactory. Thus, the use of a lead screw in the present embodiment is only exemplary and is not intended to be limiting.

Driver 110 preferably provides rotation of lead screw 112 via a mechanical link 113 with the motive force used to rotate reel 14. Moreover, driver 110 preferably shares or utilizes the same travel reversing mechanism used by level-wind 18 in order to provide oscillatory travel. Such an arrangement may facilitate the coordination of the movements of level-wind 18 and driver 110.

Figure 4:
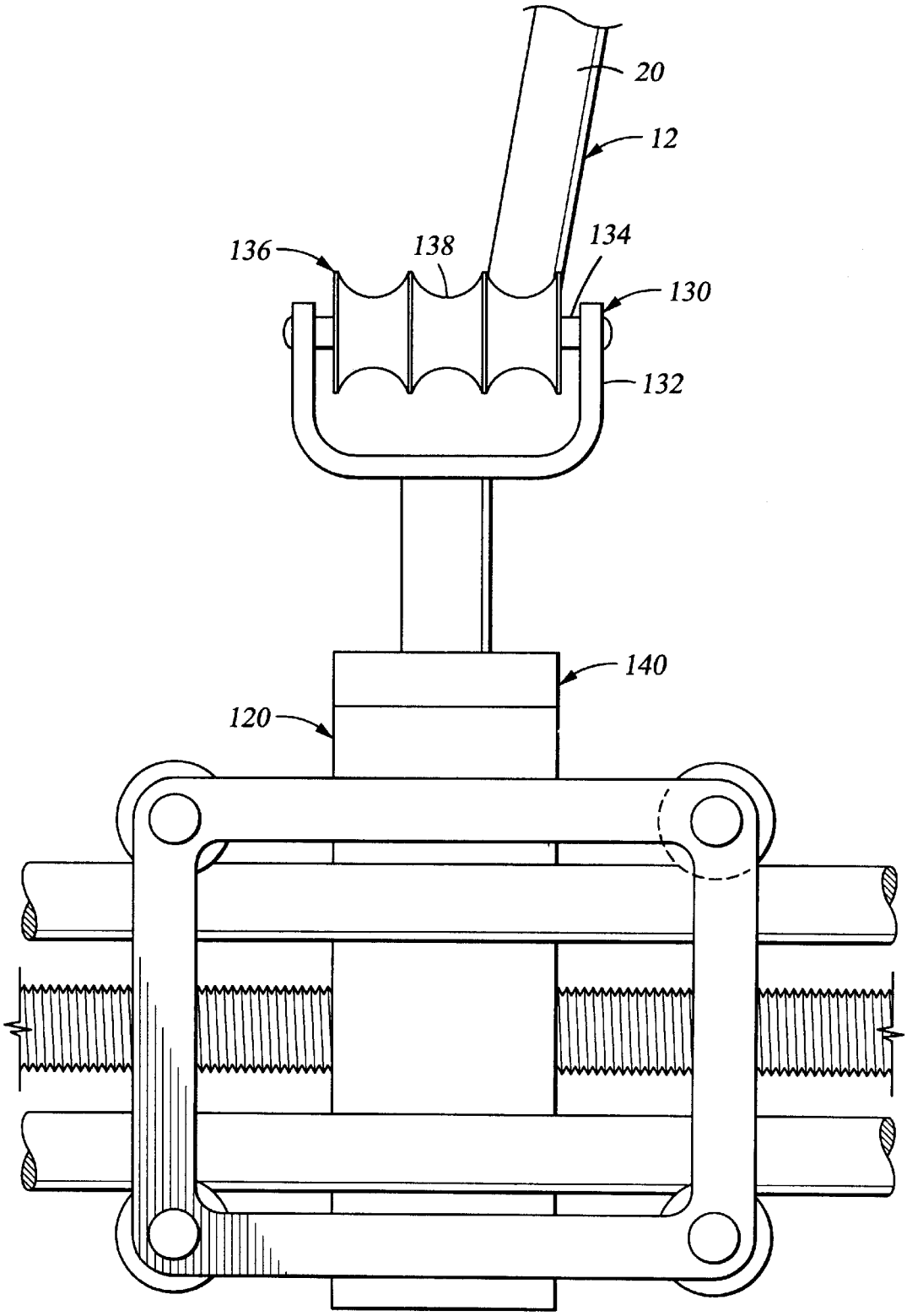
FIG. 4 is a side view of first alternative embodiment of the present invention.

Referring now to FIG. 4, guide 130 retains for coiled tubing 12 in order to prevent kinking or snaking and maintain helical layering during the spooling process. Guide 130 includes a frame 132, an axle 134, and a plurality of rollers 136. Frame 132 may be fashioned as a U bracket with axle 134 disposed therein. In one embodiment, three rollers 136 are rotatably mounted onto axle 134. Rollers 136 may be formed from any material suited to well rig applications such as steel, elastomers or natural rubber. Each roller 136 preferably includes a concave surface 138 for seating coiled tubing 12. The contour of concave surface 138 is substantially similar to the exterior shape of coiled tubing 12 in order to closely receive windings 20 of coiled tubing 12 as it is being spooled onto reel 14. Rollers 136 may be fixably connected to each other or may be allowed to rotate independently on axle 134. Alternatively, a single roller incorporating a plurality of concave surfaces adapted to receive consecutive windings of coiled tubing 12 may be used. Moreover, it should be understood that rollers 136 need not incorporate any form of contoured surfaces. Any configuration that provides a surface capable of maintaining coiled tubing 12 in a helical layer is suitable for guide 130.

Referring still to FIG. 4, biasing member 140 urges guide 130 against the windings 20 of coiled tubing 12 so as to radially compress windings 20 against reel 14. Guide 130 moves radially outward in order to accommodate the growing circumferential size of coiled tubing windings 20 spooled onto reel 14. Biasing member 140 is interposed between guide frame 132 and base 120 to regulate the radially outward movement of guide 130. Preferably, biasing member 140 is provided as a piston cylinder arrangement. Alternatively, the biasing mechanism may be a mechanical spring or a fluid chamber that provides hydraulic pressure. Biasing member 140 may be integral with base 120 or attached to base 120 using a threaded connection or other suitable connection means. Further, biasing member 140 may be configured to provide a constant spring force throughout the spooling process or an increasing or decreasing spring force. The precise spring force required to retain the windings will depend on the particular application. Generally, the spring force should be sufficiently high to minimize the undesired movement of coiled tubing 12 on reel 14. However, the spring force should not be so high as to inhibit the spooling operation or damage coiled tubing 12.

Figure 5:
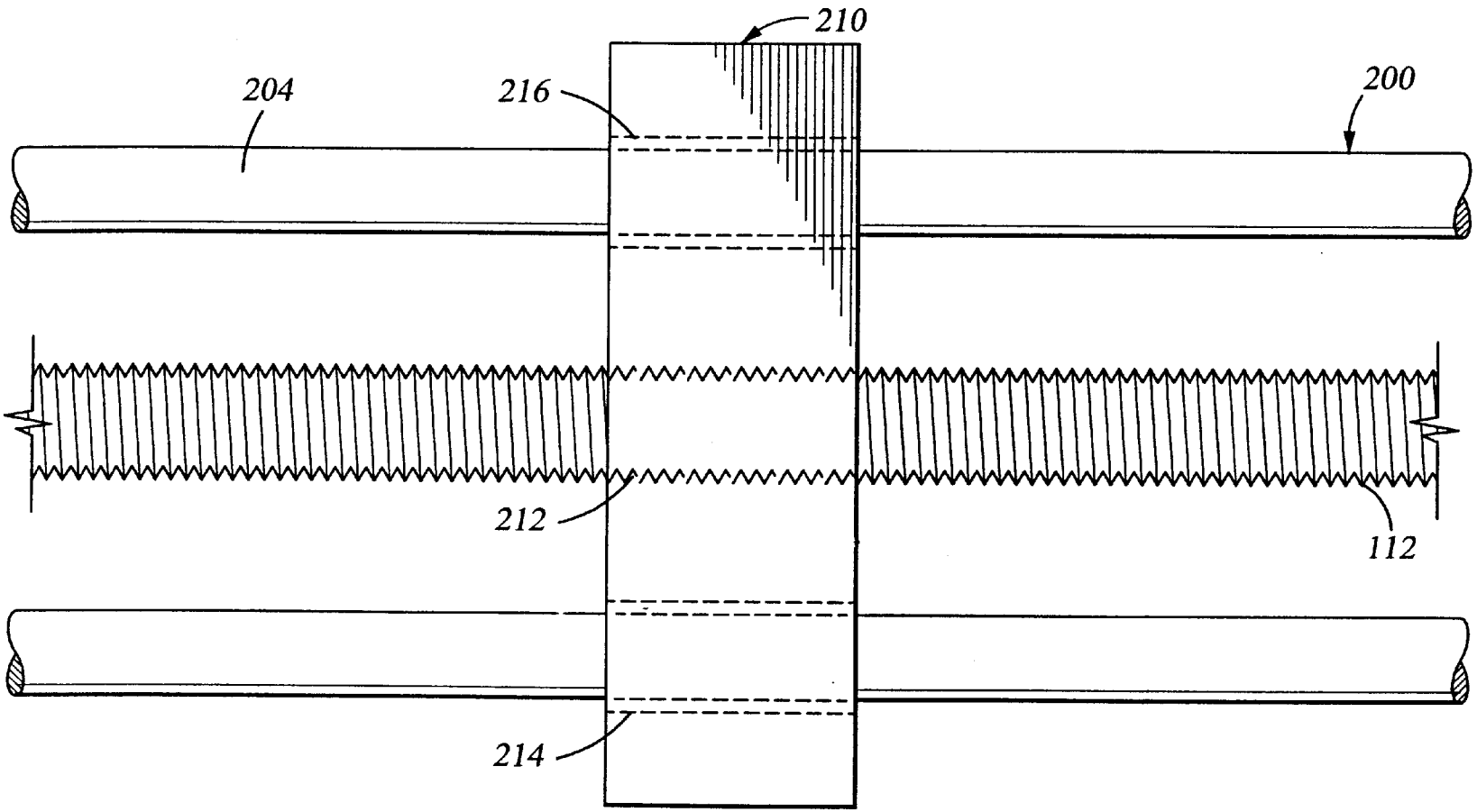
FIG. 5 is a side view of an alternate driver/base of the FIG. 4 embodiment of the present invention.

It should be understood that there are numerous arrangements and variations that may be provided for winding tool 10. For example, referring now to FIG. 5, an alternate track 200 and base 210 are shown. In this embodiment, track 200 includes two rails 204. Base 210 includes a threaded bore 212 to receive lead screw 112 and two bores 214, 216 to receive track rails 204. Thus, in this arrangement, base 210 is propelled axially by the interaction between lead screw 112 and threaded bore 212 and is stabilized by the interaction between the bores 214, 216 and rails 204.

Figure 6:
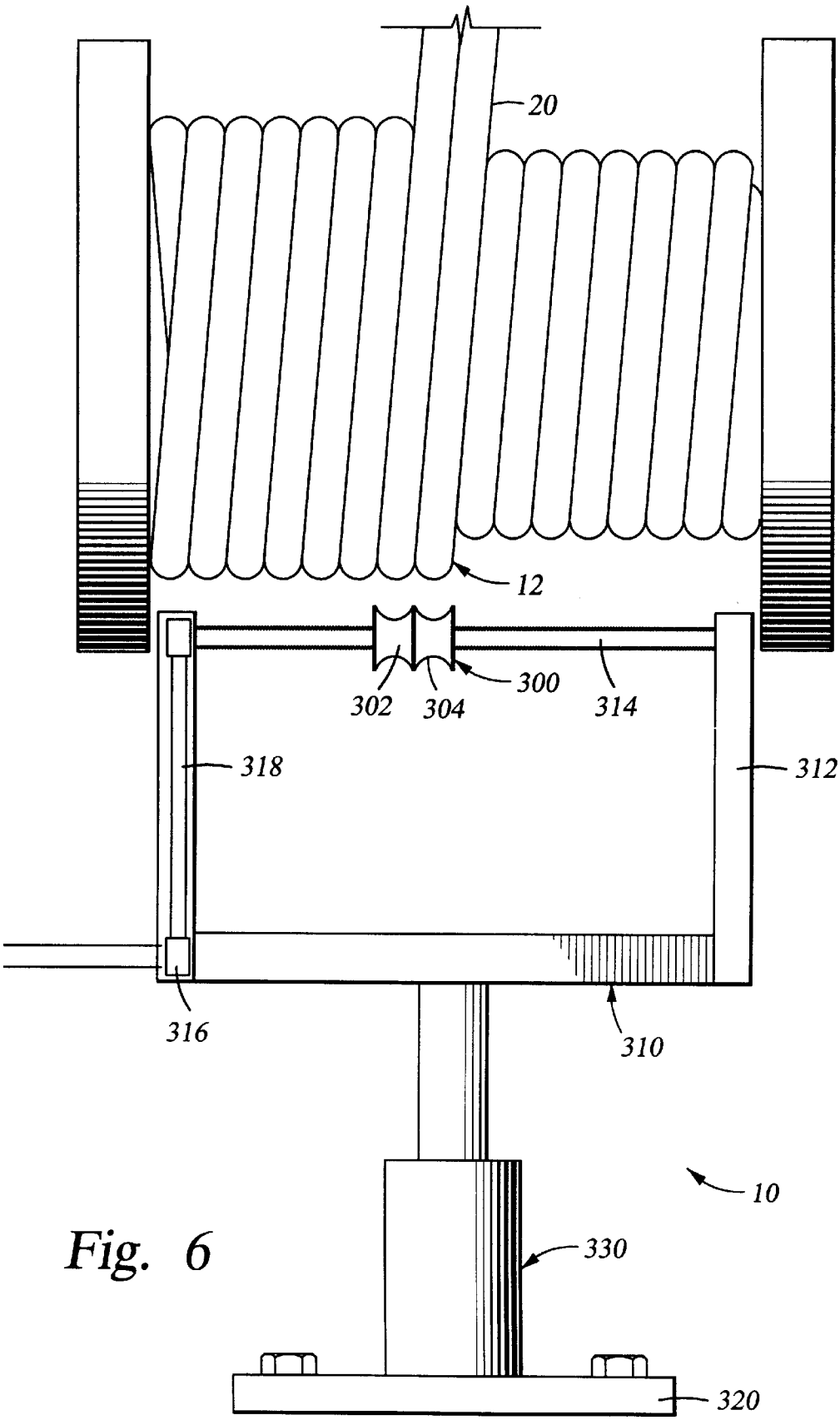
FIG. 6 is a side view of a second alternative embodiment of the present invention.

Referring now to FIG. 6, another embodiment of the present invention is shown. Here, winding tool 10 includes a guide 300, a driver 310 and a biasing member 330. Guide 300 includes a pair of rollers 302 having arcuate surfaces 304 for receiving successive windings 20 of coiled tubing 12. While two rollers 302 are shown, more or fewer rollers may be used. Driver 310 includes a housing 312 and a lead screw 314. Guide rollers 302 are threadedly disposed on lead screw 314. Lead screw 314 engages a drive disk 316 via a belt 318. Drive disk 316 connects to an external rotator (not shown). Biasing member 330 is preferably mounted on a platform 320 and urges guide 300 against windings 20 of coiled tubing 12. It will be appreciated that the FIG. 6 embodiment provides a winding tool 10 with a high degree of portability and interchangeability.

Figure 7:
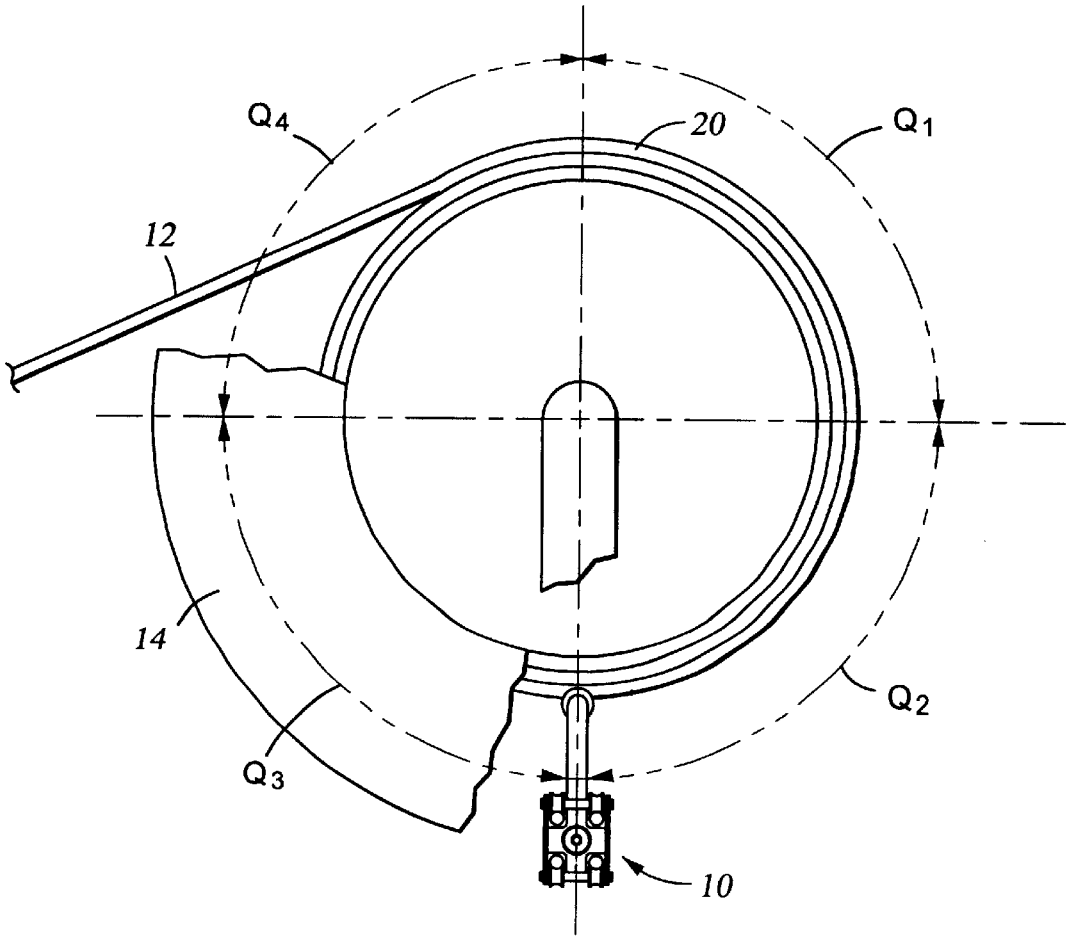
FIG. 7 is a Partial cutaway view of a reel arrangement using an embodiment of the present invention.

Referring now to FIG. 7, winding tool 10 preferably engages a newly spooled winding 20 at a location most susceptible to snaking or other undesirable movement. Reel 14 may be described as having first, second, third and fourth quadrants Q1,Q2,Q3,Q4. During normal spooling operations, the level-wind (not shown) directs coiled tubing 12 to generally the fourth quadrant Q4 of reel 14. Back tension in coiled tubing 12 tends to diminish the likelihood of snaking as coil tubing proceeds through first quadrant Q1 of reel 14. However, the tendency of coiled tubing 12 to snake usually manifests itself as coiled tubing 12 proceeds through the second and third quadrants Q2, Q3 of reel 14. The transition point between the second and third quadrants Q2, Q3 is often referred to as the "belly" of reel 14. Accordingly, winding tool 10 is preferably installed proximate to the belly of reel 14 in order to eliminate the snaking of coiled tubing 12 in that region. However, such a location for winding tool 10 is not critical to satisfactory operation. Factors such as safety, space and maintenance requirements or a different spooling technique may require that the winding tool 10 be oriented in another manner. Likewise, it may be ascertained during field use that installing winding tool 10 a location other than the belly of reel 14 provides satisfactory performance. Thus, it is seen that winding tool 10 may be adapted to nearly any spooling system.

During use, the reel is rotated in a manner such that the coiled tubing is withdrawn from the borehole. The coiled tubing is guided by the level-wind into a specific area on the reel. As the level-wind travels along the axis of the reel, the level-wind deposits windings of coiled tubing in a helical pattern. As consecutive windings of coiled tubing are directed onto the reel by the level-wind, the rollers of the winding tool urge the newly spooled windings of the coiled tubing against the reel. The pressure provided by the roller prevents the newly placed winding from jumping or otherwise deforming from the desired helical pattern. The winding tool follows along with the level-wind to assist in maintaining the tight helical pattern for each newly spooled layer of tubing. For much of the spooling process, the action of the roller and level-wind may sometimes be automatic. However, when the level-wind and the rollers reach the furthest extent of axial travel along the reel, it may be preferable to have a manual override for human control of the winding process.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A winding tool for a reel receiving consecutive windings of composite coiled tubing that is susceptible to snaking, the winding tool comprising:

a guide positioned proximate to the reel and adapted to seat against at least one winding of coiled tubing and applied both an axial and a radial force to said at least one winding;

a biasing member urging said guide against the reel; and a driver associated with said guide, said driver providing oscillatory translational movement for said guide.

2. The winding tool of claim 1 wherein said guide comprises a roller, said roller including a concave surface for seating a winding of composite coiled tubing.

3. The winding tool of claim 1 wherein said biasing member comprises a hydraulic piston.

4. The winding tool of claim 1 wherein said driver moves said guide a distance equivalent to the diameter of the coiled tubing per one reel rotation.

5. The winding tool of claim 1 wherein said driver comprises a threaded lead screw and said guide includes a threaded bore for threadedly engaging said threaded lead screw.

6. The winding tool of claim 1 further comprising a level-wind, said level-wind placing a winding of coiled tubing at a desired location on the reel prior to said guide seating against the winding of coiled tubing.

7. The winding tool of claim 6 wherein said driver movement is coordinated with the operation of said level-wind.

8. A winding tool for a reel adapted to spool composite coiled tubing, the winding tool comprising:

a guide having frame, an axle disposed within said frame, and a plurality of rollers rotatably mounted on said axle;

a biasing member urging said guide against the reel, said biasing member having a top portion secured to said guide frame and a bottom portion;

a base connected to said biasing member bottom portion; and a driver engaging said base, said driver providing oscillatory translational movement for said base.

9. The winding tool of claim 8 wherein said rollers include a concave surface.

10. The winding tool of claim 8 wherein said biasing member comprises a hydraulic piston.

11. The winding tool of claim 8, further comprising a level-wind, said level-wind placing a winding of coiled tubing at a desired location on the reel, said driver and said level-wind having coordinated translational movement.

12. A winding tool for a reel adapted to spool composite coiled tubing, the winding tool comprising:

a guide having frame, an axle disposed within said frame, and a plurality of rollers rotatably mounted on said axle;

a biasing member urging said guide against the reel, said biasing member having a top portion secured to said guide frame and a bottom portion;

a base connected to said biasing member bottom portion; and a driver engaging said base, said driver providing oscillatory translational movement for said base, wherein said base comprises a threaded bore and said driver comprises a threaded lead screw adapted to engage said base threaded bore.

13. A winding tool for a reel adapted to spool composite coiled tubing, the winding tool comprising:

a guide having frame, an axle disposed within said frame, and a plurality of rollers rotatably mounted on said axle;

a biasing member urging said guide against the reel, said biasing member having a top portion secured to said guide frame and a bottom portion;

a base connected to said biasing member bottom portion; and a driver engaging said base, said driver providing oscillatory translational movement for said base, further comprising at least one rail disposed co-axially with said driver, wherein said base rides on said rail.

14. The winding tool of claim 13 wherein said base includes at least one wheel adapted to ride on said rail.

15. A method for spooling coiled tubing onto a reel where the composite coiled tubing is susceptible to undesirable movement, comprising:

(a) rotating the reel;

(b) directing coiled tubing onto the reel to form a plurality of consecutive windings;

(c) restraining subsequent movement of the windings on the reel by applying a compressive force and an axial force against the winding of coiled tubing, said compressive force being normal to the axis of the reel and said axial force being parallel to the axis of the reel; and (d) moving the application of the compressive force along a line parallel to the axis of the reel.

16. The method of claim 15 wherein the compressive force of step (c) is applied on each winding for at least one reel revolution.

17. The method of claim 15 wherein step (b) is performed using a level-wind that oscillates along the axis of the reel.

18. The method of claim 17 wherein step (c) is performed by a roller urging the winding against the reel, and wherein step (d) is accomplished by moving the roller.

19. The method of claim 18 wherein the movement of the roller of step (d) is coordinated with the movement of the level-wind of step (b).

20. A system for deploying and retrieving composite coiled tubing in a well bore, the system comprising:

a platform positioned proximate to the well bore;

a reel disposed on said platform;

a span of composite coiled tubing having a first end fixed to said reel, and a subsurface portion disposed in the well bore;

a level-wind for directing the subsurface composite coiled tubing to a specific area on said reel during retrieval, said level-wind directing said composite coiled tubing such that said composite coiled tubing spools in helical layers;

a guide applying a compressive force against the composite coiled tubing on the reel during retrieval; and a driver associated with said guide, said driver providing oscillatory axial movement for said guide.

21. The system of claim 20 wherein said guide includes a roller engaging the composite coiled tubing.

22. The system of claim 21 wherein said guide includes a biasing member urging said roller against the composite coiled tubing.

23. The system of claim 22 wherein the driver movement is coordinated with the operation of said level-wind.

* * * * *